US008204835B1

(12) United States Patent
Ogg

(10) Patent No.: US 8,204,835 B1
(45) Date of Patent: Jun. 19, 2012

(54) SYSTEM AND METHOD FOR PRINTING AN APPLICATION OF DYNAMICALLY VALUED INDICIA

(75) Inventor: Craig Ogg, Long Beach, CA (US)

(73) Assignee: Stamps.com Inc., Los Angeles, CA (US)

( * ) Notice: Subject to any disclaimer, the term of this patent is extended or adjusted under 35 U.S.C. 154(b) by 927 days.

(21) Appl. No.: 10/696,221

(22) Filed: Oct. 29, 2003

(51) Int. Cl.
*G07B 17/02* (2006.01)

(52) U.S. Cl. ..... 705/401

(58) Field of Classification Search ..... None
See application file for complete search history.

(56) References Cited

U.S. PATENT DOCUMENTS

| | | | | |
|---|---|---|---|---|
| 4,739,343 | A * | 4/1988 | Dolan | 347/214 |
| 4,876,000 | A * | 10/1989 | Mikhail | 209/584 |
| 5,094,554 | A | 3/1992 | Hurd et al. | |
| 5,606,507 | A | 2/1997 | Kara | |
| 5,836,617 | A * | 11/1998 | Beaudoin et al. | 283/67 |
| 6,175,826 | B1 | 1/2001 | Malandra, Jr. et al. | |
| 6,208,980 | B1 | 3/2001 | Kara | |
| 6,520,342 | B1 * | 2/2003 | Dumke et al. | 209/539 |
| 6,594,374 | B1 * | 7/2003 | Beckstrom et al. | 382/101 |
| 6,939,062 | B2 * | 9/2005 | Ogg et al. | 400/62 |
| 7,043,053 | B1 * | 5/2006 | Patton et al. | 382/101 |
| 7,056,410 | B2 * | 6/2006 | Kuller et al. | 156/277 |
| 7,127,434 | B2 * | 10/2006 | Burningham | 705/401 |
| 2001/0037320 | A1 * | 11/2001 | Allport et al. | 705/405 |
| 2002/0002544 | A1 * | 1/2002 | Leon et al. | 705/61 |
| 2002/0040333 | A1 | 4/2002 | Fuwa | |
| 2002/0065577 | A1 | 5/2002 | Teraura et al. | |
| 2002/0073039 | A1 * | 6/2002 | Ogg et al. | 705/60 |
| 2002/0073052 | A1 * | 6/2002 | Katikaneni et al. | 705/408 |
| 2003/0014376 | A1 * | 1/2003 | DeWitt et al. | 705/406 |
| 2003/0024745 | A1 | 2/2003 | Huitt et al. | |
| 2003/0140017 | A1 * | 7/2003 | Patton et al. | 705/410 |
| 2003/0193530 | A1 | 10/2003 | Blackman et al. | |
| 2004/0254898 | A1 * | 12/2004 | Parker et al. | 705/402 |
| 2005/0077346 | A1 * | 4/2005 | Dutta et al. | 235/375 |
| 2005/0080751 | A1 * | 4/2005 | Burningham | 705/401 |
| 2007/0067248 | A1 | 3/2007 | Chatte | |

OTHER PUBLICATIONS

"Royal Mail psots out new look stamp books created by CDT Design", Design Week, Jul. 4, 2002.*
U.S. Appl. No. 10/606,579, Craig Ogg.
U.S. Appl. No. 10/643,745, C. Ogg et al.
U.S. Appl. No. 10/677,619, Craig Ogg.
U.S. Appl. No. 10/677,829, Craig Ogg.
U.S. Appl. No. 10/679,861, Craig Ogg.
"Information-Based Indicia Program (IBIP): Performance Criteria for Information-Based Indicia and Security Architecture for Open IBI Postage Evidencing Systems", Feb. 23, 2000, The United States Postal Service (USPS), 80 pages.

* cited by examiner

*Primary Examiner* — Rutao Wu
(74) *Attorney, Agent, or Firm* — Fulbright & Jaworski L.L.P.

(57) ABSTRACT

A system and method for applying postage indicia to mail pieces using a controller for monitoring the mail pieces as they are processed by the system. The controller has information about each of the mail pieces. A postage evidencing system prints postage indicia on labels to create postage indicia to be applied to the mail pieces, wherein each of the postage indicia is associated with a particular mail piece and corresponds to a postage amount that is calculated using the information for the particular mail piece. An applicator applies the postage indicia to mail pieces.

19 Claims, 3 Drawing Sheets

CONTROLLER
14
INPUT
101
100
15
APPLICATOR 13-1
100-1
PRINT HEAD
12-2
12-1
QUALITY
MONITOR
16
QUALITY
MONITOR
13
12
POSTAGE
EVIDENCING
SYSTEM
17
CATCH BIN
11

10

13
13-1
13-2

SYSTEM AND METHOD FOR PRINTING AN APPLICATION OF DYNAMICALLY VALUED INDICIA

CROSS-REFERENCE TO RELATED APPLICATIONS

The present application is related to co-pending U.S. patent application Ser. No. 10/606,579, entitled "SYSTEM AND METHOD FOR AUTOMATICALLY PROCESSING MAIL," filed Jun. 26, 2003; co-pending U.S. patent application Ser. No. 10/643,745, entitled "SYSTEM AND METHOD FOR DYNAMICALLY PARTITIONING A POSTAGE EVIDENCING METER," filed Aug. 19, 2003; U.S. patent application Ser. No. 10/677,619, entitled "SYSTEM AND METHOD FOR HIGH-SPEED POSTAGE APPLICATION MANAGEMENT," filed Oct. 2, 2003 and published as 2005/0075990 on Apr. 7, 2005; U.S. patent application Ser. No. 10/677,829, entitled "SYSTEM AND METHOD FOR ACCESSING A REMOTE POSTAGE METER ACCOUNT FROM A DEVICE THAT HAS A DEDICATED LOCAL METER AND ACCOUNT," filed Oct. 2, 2003 and published as 2005/0075991 on Apr. 7, 2005; and U.S. patent application Ser. No. 10/679,861, entitled "SYSTEM AND METHOD FOR CONTROLLING POSTAGE USAGE INDEPENDENT OF METER BALANCE," filed Oct. 6, 2003, the disclosures of which are hereby incorporated by reference herein.

TECHNICAL FIELD

The present invention relates generally to applying postage indicia to mail pieces and, more particularly, to printing indicia each having unique postage value to be applied to mail pieces by a bulk mail processing system.

BACKGROUND OF THE INVENTION

Surveys conducted by the U.S. Postal Service (USPS) show that people have a better mail experience from mail pieces or envelopes that have traditional postage stamps affixed as compared to mail pieces that use meter marks or permit mail. This is because the mail appears more personalized when a traditional stamp is used, while metered mail and permit mail appears to be machine-generated and impersonal.

Some existing mail systems have the capability to apply stamps to mail pieces, such as direct mail that is sent to customers. These systems use large rolls of stamps that are applied to envelopes in an automated fashion at high speed. The existing systems are limited to using stamps of a single value that can be applied to bulk mailing pieces. This limitation prevents the use of postage stamps on bulk mailing jobs that have variable contents. This is particularly a problem for mail pieces that include personalized offers that vary based on the individual receiving them. The contents of such mail pieces often vary depending upon factors such as the location, income level, or buying habits of the recipient. As a result, the weight of individual mail pieces vary, which requires different postage amounts for each mail piece.

SUMMARY OF THE INVENTION

The present invention is directed to a system and method that prints postage indicia representing varying values and matches the printed indicia to an appropriate mail piece. The postage indicia may be printed on blank labels that are available singly, in sheets of multiple labels, or in rolls of multiple labels. The indicia can be printed on the labels either as they are needed, or sheets or rolls can be printed ahead of time and held for future use. The labels are preferably self-adhesive and are peeled from the backing in a selected order to be applied to mail pieces. The labels can be printed with indicia off-line in a production environment and then made available at the proper time for placing on an envelope.

The term postage indicia is used broadly herein to mean any one of numerous elements for representing postage amounts and other information in computer-generated postage. Postage indicia is a new form of postage that is equivalent to traditional postage stamps and metered postage. For example, the postage indicia may include a postage amount, date information, security information, digital signature information, postal authority data, unique postage meter information, and the like. The postage indicia may be printed in machine-readable and/or human-readable formats. For example, the postage indicia may be a 2-dimensional bar code that complies with a format established by a postal authority. The format of the postage indicia may be generated in one device, such as a postage meter, and then transmitted as an image or bitmap to another device for printing.

In a preferred embodiment, the postage indicia includes a postage amount and security information. The postage indicia may be printed on a label for later use on mail pieces without requiring use within a certain period of time. The postage indicia is also preferably not limited to a particular address or destination.

In embodiments of the present invention, each piece of mail in a bulk mailing has a different weight and/or destination and/or class and, therefore, each requires different postage amounts. Labels are printed with postage indicia in a secure manner while the bulk mailing is being processed. This avoids the need to have preprinted postage stamps of various values on hand for processing, instead postage indicia having the required value is printed as it is needed.

A system embodying the present invention applies postage indicia to mail pieces using a controller for monitoring the mail pieces as they are processed by the system. The controller has information about each of the mail pieces, such as the weight, destination, postal class, or contents of each mail piece. The system also comprises a postage evidencing system for printing postage indicia on labels to create postage indicia that are applied to the mail pieces. Each of these postage indicia is associated with a particular mail piece and has a postage amount that is calculated using the unique information for the particular mail piece. An applicator applies the labels to the mail pieces.

In certain embodiments, the postage evidencing system may print two or more labels for a particular mail piece. The combined postage value of the two or more labels equals at least a required postage amount for the mail piece. Additionally, the postage evidencing system may print a selected image on the labels in addition to the postage indicia. The selected image is selected based upon a characteristic of the recipient and is separate from the postage indicia. The image is printed in addition to the postage indicia.

The invention is also directed to a method for printing postage indicia on labels. The method comprises receiving information associated with mail pieces that require postage, wherein the information can be used to determine a required postage amount, and printing indicia corresponding to the required postage amount on blank labels to create postage indicia, wherein at least two of the postage indicia are not identical. The method may further comprise calculating the required postage amount from the information associated with the mail pieces. The received information associated with the mail pieces may include a required postage amount.

In addition to printing the required postage indicia, in embodiments of the invention, an image is printed on the blank labels in addition to the postage indicia to create postage indicia. In a bulk mail processing system, each of the postage indicia are associated with a particular mail piece that is designated for a particular recipient. The image may be selected based upon one or more characteristics of the particular recipient, such as the recipient's age, sex, occupation, or location. A single image may be printed on a plurality of labels that each have varying postage indicia. Alternatively, indicia representing a single postage amount may be printed on a plurality of labels that each have varying images printed thereon.

A system and method for creating postage indicia for use on mail pieces comprises calculating a postage amount due for each of the mail pieces, printing postage indicia corresponding to the postage amount on blank labels to create postage indicia for use on the mail pieces, wherein each of the postage indicia is associated with a particular one of the mail pieces, and wherein at least two of the postage indicia are not identical, and applying the postage indicia to the associated mail pieces.

The present invention monitors the quality of the postage indicia to ensure that the proper postage indicia was evidenced, and monitors the quality of the mail pieces to ensure that the postage indicia or printed labels have been properly applied.

The present invention also monitors the progress of mail pieces in a high-speed letter processing system, creates postage indicia having postage indicia associated with each of the mail pieces before the mail pieces arrive at a postage indicium applicator, and ensures that the correct labels having the required postage indicia are applied to each envelope.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figures 1, 1A, 1B:
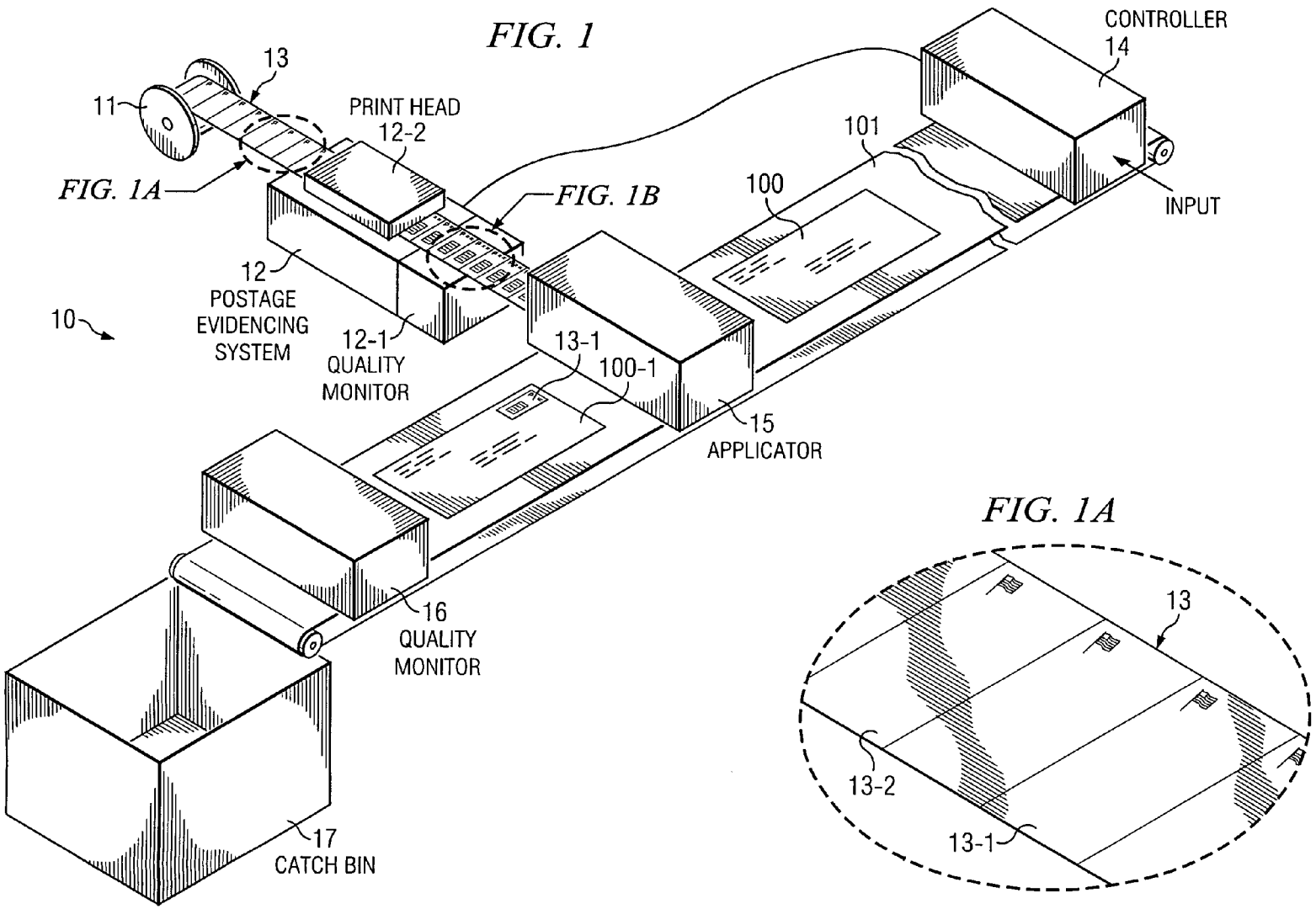
FIG. 1 illustrates a preferred embodiment of a system incorporating aspects of the present invention.
FIG. 1A illustrates blank, authorized labels without postage value applied.
FIG. 1B illustrates printed labels after postage has been applied.
Figure 1B:
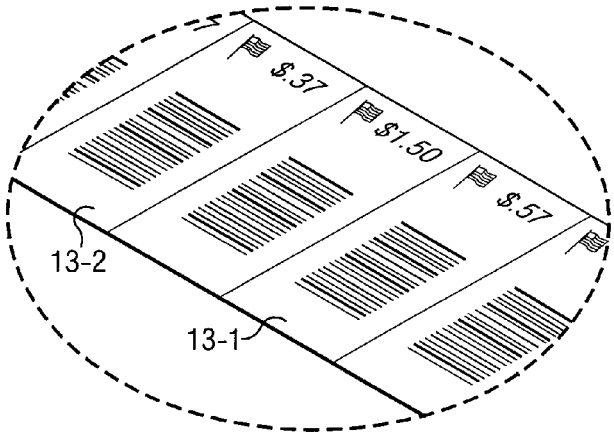

FIG. 1 illustrates a preferred embodiment of system 10 incorporating aspects of the present invention. System 10 is a portion of a high-speed mail processing system that may include mail folders, inserters and other mail processing components (not shown). Envelopes 100 travel through system 10 via conveyor system 101, which may be, for example, a conveyor belt. Controller 14 monitors the envelopes as they move through system 10 and controls the preparation of the mail pieces. As the contents of the mail pieces are prepared, folded and inserted into envelopes 100, controller 14 tracks the address, mail class and weight of each of the individual envelopes. Using this information, controller 14 calculates the postage value that is required for each envelope. Controller 14 may be any device now known or later developed for processing digital information and for controlling other devices, such as a microprocessor, Application Specific Integrated Circuit (ASIC), or the like. Postage evidencing system 12 and applicator 15 are used to print labels having postage indicia representing the required postage and to apply the labels to each envelope.

Spool 11 contains special labels 13 that are unrolled into postage evidencing system 12. FIG. 1A illustrates blank labels 13 as they come off of spool 11 before postage indicia is applied. Blank labels 13 have security measures, such as a preselected image (for example, the flag illustrated in FIG. 1A), a hologram, special inks, and/or the like, to ensure that authentic and/or authorized labels are used to create postage stamps.

Returning to FIG. 1, the roll or ribbon of labels 13 passes through postage evidencing system 12, where postage indicia is applied to the labels. Print head 12-2, which may be, for example, a high-speed ink jet printer, applies postage indicia to labels 13. As discussed above, controller 14 calculates the required postage amount for each mail piece and creates postage indicia information for that postage amount. The postage indicia information is communicated to postage evidencing system 12 and the postage indicia is printed on labels 13 by print head 12-2. Quality monitor 12-1 checks the printed labels as they are produced by postage evidencing system 12 and before they are applied to envelopes 100. Labels that fail the quality check at monitor 12-1, such as labels with misprinted postage indicia, are identified to controller 14 so that the incorrect indicia are not used on mail pieces.

FIG. 1B illustrates labels 13 after postage has been printed by print head 12-2 on individual labels. Each of labels 13 can be printed with unique postage values. For example, labels 13-1 and 13-2 have been printed with indicia representing different postage amounts. Returning to FIG. 1, applicator 15 is used to apply printed labels 13 to corresponding envelopes 100.

Applicator 15 typically applies one label per envelope. However, in alternate embodiments, applicator 15 can apply any number of labels 13 to a single envelope. Each of the labels applied to a single mail piece may have the same or unique postage values. A sender may desire to apply postage to mail pieces using indicia that have postage increments that are available from the Postal Service in order to give the appearance that the mail piece was prepared by hand. For example, the current first class postage is 37 cents. If the postage due for a mail piece is more than 37 cents, the sender may direct the postage evidencing device to print multiple indicia having values of no more than 37 cents each. In this manner, a mail piece requiring postage of 57 cents could be labeled with a single 57 cent indicium or with two indicia, one having 37 cents postage and the other having 20 cents postage. Any other combination of postage could also be used to give the mail piece a more personalized appearance. Although the postage indicia itself may be machine-readable, additional human-readable postage information is printed on the labels in a preferred embodiment.

In other embodiments, the manner in which labels 13 are printed may be personalized for the recipient. Exemplary indicia 13-1 and 13-2 in FIG. 1B represent different postage amounts and have different postage indicia, but generally the same format and image. Postage evidencing device 12 can also vary the image shown on the labels. These images are separate from the postage indicia and do not represent a postage amount. In this manner, the indicia applied to the mail pieces may be further personalized to reflect a selected theme, location, historical event or figure, holiday or other feature associated with the recipient. These features or images may be selected based upon the recipient's location, age, sex, occupation or other information. For example, in addition to printing the appropriate postage on labels 13, postage evidencing meter 12 may print a medical-related image if the recipient is a doctor or a school-related image if the recipient is a teacher.

The present invention may be used to process mail pieces that have a uniform weight and class and that require the same postage amount. For example, postage evidencing system 12 may print postage indicia representing the same postage amount on each of labels 13, but vary the image or feature on each label 13 based upon some characteristic of the recipient.

Envelope 100 is addressed before it reaches applicator 15. Controller 14 ensures that applicator 15 places the correct label 13 on each envelope 100. For example, controller 14 determines that the proper postage for envelope 101-1 is $0.57 and directs postage evidencing system 12 to print a postage label having the appropriate postage indicia as label 13-1. Then, as shown in FIG. 1, controller 14 ensures applicator 15 applies label 13-1 to envelope 100-1. After label 13-1 is applied to envelope 100-1, quality monitor 16 verifies that the label was properly applied to the envelope. In one embodiment, monitor 16 also receives the postage amounts from controller 14 and, if desired, checks the postage indicia printed on the label that was actually applied to envelope 100-1 to verify that the correct postage amount is represented in the postage indicia that was printed on label 13-1. After passing quality monitor 16, envelope 100 is placed in catch bin 17 where the stamped mail pieces are collected prior to mailing.

Figure 2:
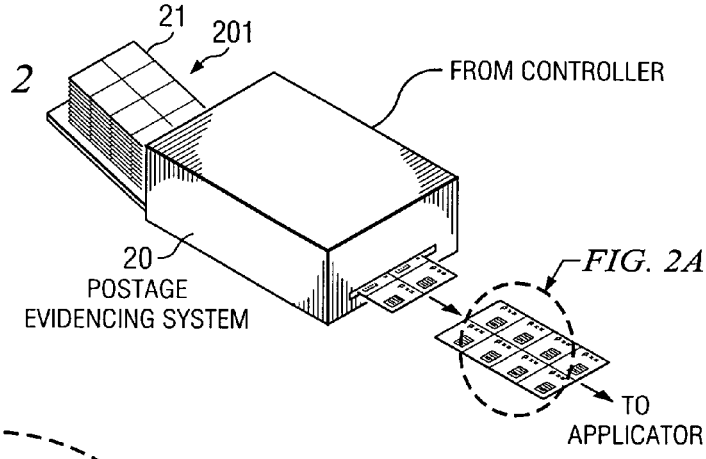
FIG. 2 illustrates an alternate embodiment of the postage evidencing system for printing labels in alternate formats.

FIG. 2 illustrates an alternative embodiment of the postage evidencing system. Postage evidencing system 20 may be used in a high-speed mail processing system, such as system 10 (FIG. 1) in place of postage evidencing system 12. Postage evidencing system 20 prints postage indicia on labels 21 from label sheets 201, instead of using spools of labels 11. Using postage amount information from a controller, such as controller 14, postage evidencing system 20 prints postage indicia on labels 21.

Figure 2A:
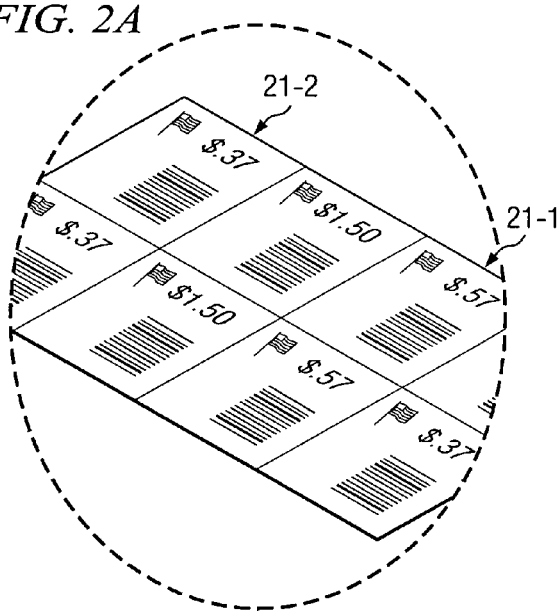
FIG. 2A illustrates printed labels after postage is applied to label sheets by an alternative postage evidencing system.

FIG. 2A illustrates printed labels 21 after the postage indicia is applied to label sheets 201 by postage evidencing system 20. As the sheets of labels are printed, each individual label 21 may have indicia representing a unique postage value. For example, labels 21-1 and 21-2 have been printed with indicia having unique postage values and each can be used on mail pieces that requires the respective postage amounts. The required postage may vary based upon the destination, weight and class of the mail pieces. An applicator, such as applicator 15 (FIG. 1) or an applicator adapted to use label sheets, is used to apply printed labels 21 from sheets 201 to envelopes. Quality checks are preformed by postage evidencing system 20. Additional quality checks are performed after the applicator to verify that the proper postage indicia has been printed on the label and applied to the mail piece.

Figure 3:
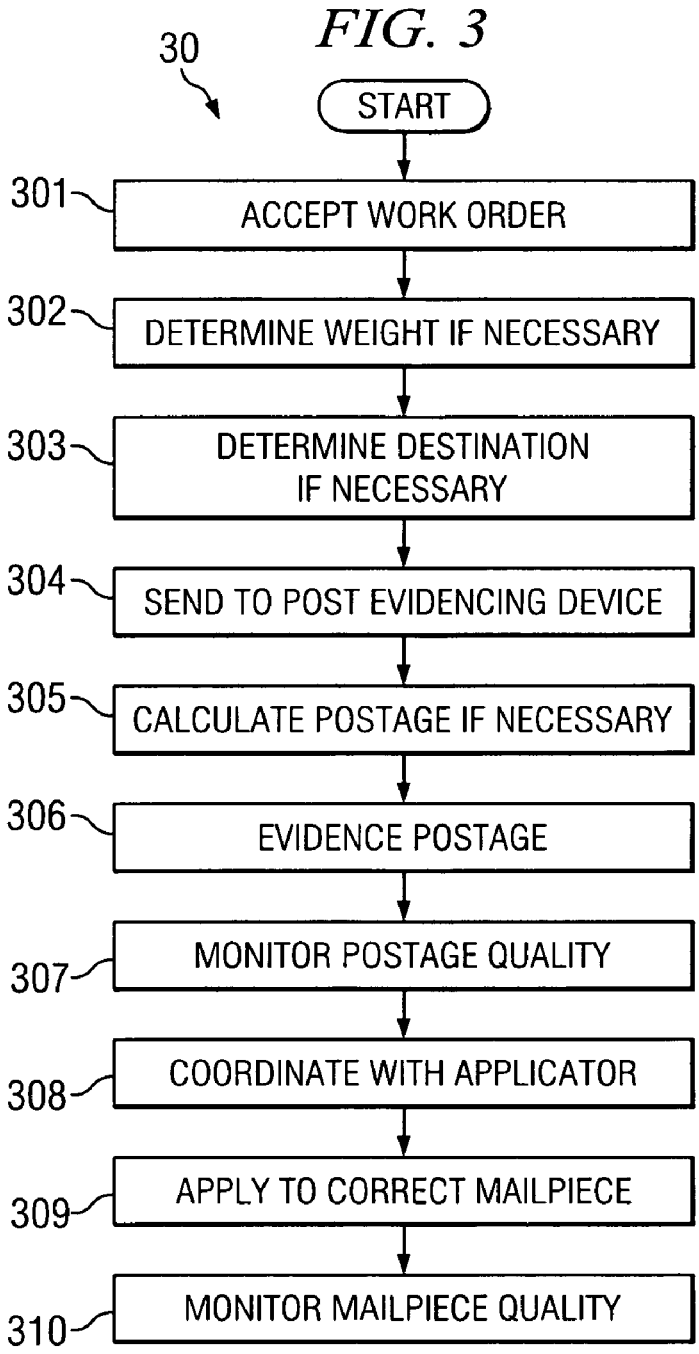
FIG. 3 is a flowchart illustrating a process for printing labels for use as postage indicia on mail pieces according to embodiments of the present invention.

FIG. 3 is a flowchart illustrating process 30 for printing labels for use as postage indicia on mail pieces according to embodiments of the present invention. Work orders are accepted at 301, which may include information such as recipient addresses, mail piece content for each recipient, postage class for each mail piece, and/or the like. While the mail pieces are being processed, the weight of individual pieces is determined at 302 and the destination for the mail piece is determined in 303.

The weight, destination and/or postal class for each mail piece is used to determine a required postage amount. A postage indicia corresponding to the required amount is generated and sent to the postage evidencing device at 304. The required postage amount can be determined by the postage evidencing device at 305, if necessary, using information about the mail pieces. Alternatively, another device, such as a controller, determines the required postage indicia for a particular mail piece and forwards postage indicia information to the postage evidencing device so that the postage indicia can be printed.

At 306, the postage amount is actually printed on a label. Preferably, the label is in a preapproved format that provides security measures to prevent fraud. The accuracy and quality of the postage indicia is checked at 307. The label is then sent to the applicator at 308 in a coordinated manner so that the proper postage indicia is applied to each mail piece or envelope at 309. Quality monitor process 310 verifies that the postage indicia is properly applied to each mail piece. If the quality of a printed label or stamped mail piece is unacceptable, then that mail piece is rejected.

In an alternate embodiment, the system and method disclosed herein operates with serialized stock. The blank roll or sheet of indicia to be printed may be numbered or serialized. The individual indicia on a roll (e.g. 13-1, 13-2 of FIG. 1A) or on a sheet (e.g. 21-1, 21-2 of FIG. 2A) may each have unique numbers. Alternatively, each indicium on a single roll or sheet may have the same number. The serialized blank stock (i.e. rolls or sheets to be printed) provide security and anti-fraud features. For example, the serial number on the stock may be printed in a bar code or in another machine-readable format. The mail processing system may read the serial number or a user may enter the serial number manually into the system. The mail processing system could then determine whether the serial number is valid, such as by comparing the number to a list of valid serial numbers. If the serial number is not valid, then the system would not print postage indicia on the stock.

The system may also maintain a list of serial numbers for used (i.e. printed) stock to ensure that the user does not reuse a valid serial number on other, unapproved stock.

In one embodiment, each label, which may be an individual label or a label on a roll or a sheet, has a unique serial number. The user enters the serial number on a user interface to the mail processing system. The mail processing system then prints postage indicia on the label. The printed postage indicia, which may be in the form of a two-dimensional barcode for example, may include the serial number of the blank label. The postage bar code may later be compared to the serial number on the label to verify that the postage is valid.

The present invention provides for the creation of computer-based postage that may be used in a manner similar to standard postage issued by the USPS. Preferably, the address of the intended recipient need not be verified at the time the postage indicia is created. The invention includes providing label stock including a master serial number. A computer system receives the master serial number and a postage request from a user. The computer generates a postage indicia using the master serial number and the postage request. The computer then prints the postage using the indicia and the label stock. In another aspect of the invention, the label stock further includes anti-fraud devices. The anti-fraud devices may include micro-printing, watermarks, the use of phosphorescent ink, and color changing ink on the label stock. In another aspect of the invention, the postage request includes a postage amount, a postage class, and an identification of a Licensing Postage Office.

The label stock includes a pre-printed serial number. The computer generates postage indicia including the pre-printed serial number. In another aspect of the invention, the master serial number is linked by the computer to a specific postage printing device. Once the master serial number and the specific printing device are linked, generation of the postage indicia further includes ensuring the master serial number is used with the specific postage printing device.

In operation, a licensed and registered client of the on-line postage system sends a request for authorization to print a desired amount of postage. A postal security device (PSD) server determines whether the user's account balance is sufficient to cover the requested amount of postage, and if so, communicates an authorization to the client system. The client system then sends image information for printing a postal indicia for the granted amount to a printer so that the postal indicia is printed on the desired media, such as a label to be applied to an envelope. Once the postage information is printed on an individual label, the label may be subsequently placed on an individual mail piece with a recipient of the users choosing and mailed and processed by the USPS.

An exemplary system utilizes special paper label stock to protect against the fraudulent production of computer-based postage indicia. The paper label stock may be available through the computer-based postage service provider, through retail outlets or other sources. In one embodiment of label stock in accordance with the present invention, multiple labels are placed on a single large sheet of label stock. The multiple labels may be arranged in any fashion. In one embodiment of a label sheet in accordance with the present invention, the labels are arranged in a rectilinear grid pattern. In another embodiment of label stock in accordance with the present invention, multiple labels are arranged in a linear fashion placed on a roll of label stock.

In accordance with an exemplary embodiment of the present invention a serial number uniquely identifies a label used to generate a postage indicium. Such a label may be termed a Postagio label. The master serial number is a manufacturer serial number that is used to track the production, distribution, and use of a particular unit of label stock. An exemplary system preferably prints computer-based postage indicia having a pre-printed serial number that matches a serial number on a Postagio label. As an added security measure, the pre-printed serial number on the Postagio label will be based on the master serial number for label stock. In one embodiment of a pre-printed serial number in accordance with the present invention, the master serial number is included as the leading 3 digits in a pre-printed serial number. This allows a customer to reuse a partial sheet of label stock, reducing waste while maintaining the secure nature of the paper.

An exemplary embodiment of the present invention uses alphanumeric serial numbers. The alphanumeric serial numbers will be broken up visually for the customer to reduce data entry errors. The master serial number will contain a checksum value and will help prevent incorrect sheet values. In operation when a user prints computer-based postage stamps an exemplary system preferably prints a serial number as part of the indicia just above the pre-printed serial number already on the label. In a preferred embodiment the printed serial number is the same font and size as the pre-printed number on the label. This allows for immediate comparison of the numbers by postal personnel.

In the described exemplary embodiment, master serial numbers and pre-printed serial numbers are tracked on a server. When a unit of label stock has been used, the server flags the meter number that used label stock. If the user prints computer-based postage indicia on a portion of label stock, the user will be able to print indicia on the remaining labels included in the label stock at a later time. However, only the meter that initially used the label stock will be permitted to print the remaining labels. Once all labels included in the label stock have been printed, the associated master serial number and pre-printed serial numbers will be flagged and any attempts to print a label using those serial numbers will be rejected by the server. A preferred embodiment will not activate all possible serial numbers. Rather, only label stock and labels having serial numbers that have been produced by a manufacturer and placed into distribution will be active and available for use.

A user may print postage indicia onto the label stock. An exemplary computer-based postage indicium is preferably different from indicia currently in use for IBIP to allow postal personnel and customers to instantly recognize and distinguish the computer-based postage indicia. However, the computer-based postage indicium preferably guards against fraud. Therefore, postage indicia printed on the Postagio labels preferably utilize a data matrix barcode format.

An exemplary computer-based postage indicium includes multiple pieces of information, some pre-printed and some printed at the time of indicia creation, to ensure the uniqueness of the indicium and ease of processing. For example, an exemplary postage indicia includes the postage amount displayed in human-readable form in the upper left-hand corner of the indicia. The postage amount is preferably displayed using the largest font size permitted given the size of the label and the indicium. The large font size helps ensure that postal personnel can quickly identify the indicium value. In addition, an exemplary system prints "U.S. Postage" under the postage amount, preferably, in a slightly smaller font than the postage amount. The term US Postage helps ensure that the indicium is identified as being domestic in origin. Further, the indicia preferably identifies the mail class served by the indicium and may include relevant information regarding the indicia origination such as, for example, the Licensing Post Office.

A computer-based postage indicium may further include a pre-printed serial number. The pre-printed serial number is a unique number printed on the bottom left-hand corner of the label to identify the sheet source and the individual label number. An exemplary system further encodes the pre-printed serial number in the indicium to ensure that the indicium is unique. In addition, a serial number will also be printed at the time the Postagio is created. This will be printed directly above the pre-printed serial number as an added fraud deterrent. If the serial numbers do not match each other and the serial number in the indicium, then the computer-based postage is not valid. The computer-based postage indicium may further include the logo of the computer-based postage provider. The logo may be pre-printed on the label. In one embodiment the label stock preferably features the provider logo as a means to guarantee that the label stock meets the necessary security requirements.

In an exemplary embodiment, the labels may also include various anti-fraud features to guard against the fraudulent production of computer-based postage indicia. For example, the label stock preferably uses phosphorescent ink. This type of ink is considered a specialized material that is not readily available to the general public, ensuring the security of the label stock. Therefore, in one embodiment each Postagio label is coated with a phosphorescent ink. The phosphorescence will also assist the automated postal handling equipment in identifying the indicium. In addition, the computer-based postage indicia will preferably be cut with a special die to further ensure the security of the Postagio labels. In one embodiment of a special die in accordance with the present invention, the cutting edges of the die do not follow a straight line. Instead the cutting edges are composed of a sequence of specially angled lines.

The label stock may further include watermark printing in the form of a printed background graphic (preferably in that range of about 10-20% color saturation). The watermark printing is visible to the eye and not easily reproduced.

The Postagio label stock may further include micro-printing that is invisible to the naked-eye, but can be seen under a microscope. The micro-printing provides an additional security measure, since it cannot be easily reproduced. In a preferred embodiment the micro-printing is limited to the space to the left of the indicium. The micro-printing preferably reads "U.S. Mail/name of the service provider."

In addition, the service provider's logo may be printed on each Postagio label. The logo helps ensure that an authorized vendor designated by both the service provider and the postal service created the label. In addition, it will help the postal service to quickly identify the product that created the Postagio. Finally as previously described a pre-printed serial number with thermally sensitive color-changing ink, known as thermochromatic ink, may be included on the Postagio label stock. The serial number uniquely identifies the Postagio label. In one embodiment, the serial number on the label must match the number printed by the service provider as well as the number in the indicium. The color-changing ink ensures that a designated vendor created the Postagio label.

The Postagio label stock preferably does not use optical brightening agents, to prevent a reaction under black light. In addition, different color paper may be offered, possibly including white, ivory, blue, pink, peach, and gray. All paper will be tested to ensure compliance with the anti-fluorescent requirements and to ensure that the indicia is still easily scannable. Colors will preferably have a maximum saturation in a range of about 10-30% saturation. In addition, the label design preferably accounts for print engine tolerance in placement of specific elements.

The user provides the master serial number of a sheet or roll of label stock to the system for generating computer-based postage. The user selects a printer type from a printer type menu. The printer type may determine whether sheet label stock or roll label stock is being used. In an embodiment of an exemplary system for generating computer-based postage in accordance with the present invention, the entered serial number is validated by checking the pre-printed serial number against a database of valid pre-printed serial numbers and also by checking the type of the label stock associated with the pre-printed serial number.

The user may print postage on a partial sheet of labels. In this case, the user selects one or more labels to print. When the user selects the partial sheet button and selects the labels that the user wants to print, a sheet label stock display is generated showing labels that will be printed.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for creating valid postage labels for use on mail pieces, comprising:

monitoring a location of mail pieces in a high-speed letter processing system;

calculating a postage amount due for each of the mail pieces;

creating valid postage labels associated with each of the mail pieces before the mail pieces arrive at a location comprising a postage indicium applicator;

printing, by a printer on blank labels, the valid postage labels comprising postage indicia corresponding to the postage amount calculated for the mail pieces and comprising images, wherein each of the postage indicia is associated with a particular one of the mail pieces, and wherein said images of at least two of the valid postage labels are not identical;

applying, by said high-speed letter processing system, the valid postage labels to the associated mail pieces wherein no human readable portions of said valid postage labels display permit information and wherein the valid postage labels display a postage amount in an increment that is available from the delivery service, whereby said associated mail pieces have an appearance of a mail item comprising a postage stamp that was obtained from a delivery service and was applied by hand; and coordinating the operation of the postage indicium applicator and the location of the mail pieces to ensure that the correct valid postage labels are applied to each envelope.

2. The method of claim 1 further comprising:

monitoring the quality of the valid postage labels to ensure that the proper postage valid postage labels were printed.

3. The method of claim 1 further comprising:

monitoring the quality of the mail pieces to ensure that the valid postage labels have been properly applied.

4. The method of claim 1 further comprising:

monitoring the quality of the mail pieces to ensure that the postage indicia represents a proper postage amount.

5. The method of claim 1 wherein the calculating step further comprises:

determining a destination for a mail piece; and calculating the postage amount based upon the destination of the mail piece.

6. The method of claim 1 wherein the calculating step further comprises:

determining a weight for a mail piece; and calculating the postage amount based upon the weight of the mail piece.

7. The method of claim 1 wherein each of the postage indicia are associated with a mail piece that is designated for a particular recipient, and wherein the each of the valid postage labels comprise an image, wherein the image is selected based upon one or more characteristics of the associated particular recipient.

8. The method of claim 7 wherein the one or more characteristics of the recipient are selected from the group consisting of:

the recipient's age;

the recipient's sex;

the recipient's occupation; and the recipient's location.

9. The method of claim 1 wherein the blank labels comprise a roll of blank labels that are printed in series.

10. The method of claim 1 wherein the blank labels comprise a sheet of blank labels.

11. The method of claim 1 wherein the blank labels comprise a serial number.

12. The method of claim 11 further comprising:

verifying that the serial number is valid.

13. The method of claim 11 wherein the printed postage indicia includes the serial number.

14. The method of claim 1 wherein the printing step further comprises:

receiving label stock having a pre-printed serial number, the pre-printed serial number including a master serial number;

generating postage indicia using the master serial number, pre-printed serial number, and required request; and printing the postage indicia on the label stock.

15. The method of claim 1 further comprising:

verifying that the correct valid postage labels are applied to each mail piece.

16. The method of claim 1 wherein each of the valid postage labels comprise an image and each of the images is selected based on recipient characteristics of a particular one of the mail pieces.

17. A method comprising:

creating a machine generated postage stamp, by a high speed mail item computer processing system, said creating including:

receiving, by the high speed mail item computer processing system, information associated with each of a plurality of the mail pieces, wherein the high speed mail item computer processing system determines a postage amount for each postage indicia to be printed based on the information; and printing, by a printer, said machine generated postage stamp including a postage indicium and an image, wherein the postage indicium is associated with a particular one of the plurality of mail pieces and bears at least the determined postage amount, and wherein the image is selected based on characteristics of a recipient of the particular one of the plurality of mail pieces; and affixing the machine generated postage stamp to the mail pieces to provide mail pieces processed by the high speed mail item computer processing system that have the appearance of a mail piece comprising a postage stamp that was obtained from a delivery service and was applied by hand, wherein the machine generated postage stamp is two separate labels appearing to be two different postage stamps which display postage amounts in increments that are offered by the delivery service and the two postage amounts displayed by the two separate labels total at least the determined postage amount.

18. The method of claim 17 wherein at least two of the machine generated postage stamp bear different images and different postage amounts.

19. The method of claim 17 wherein no human readable portions of said valid postage labels display permit information.

* * * * *